US012465113B2

(12) United States Patent
Stollenwerk, Jr. et al.

(10) Patent No.: US 12,465,113 B2
(45) Date of Patent: Nov. 11, 2025

(54) SYSTEMS AND METHODS FOR CUSHIONED FOOTWEAR

(71) Applicant: Solwerk, Elm Grove, WI (US)

(72) Inventors: John Stollenwerk, Jr., Elm Grove, WI (US); Javier Solis, Franklin, WI (US)

(73) Assignee: Solwerk, Elm Grove, WI (US)

( * ) Notice: Subject to any disclaimer, the term of this patent is extended or adjusted under 35 U.S.C. 154(b) by 0 days.

(21) Appl. No.: 17/620,302

(22) PCT Filed: May 17, 2021

(86) PCT No.: PCT/US2021/032702

§ 371 (c)(1),
(2) Date: Dec. 17, 2021

(87) PCT Pub. No.: WO2022/245327

PCT Pub. Date: Nov. 24, 2022

(65) Prior Publication Data

US 2024/0008594 A1 Jan. 11, 2024

(51) Int. Cl.

| | |
|---|---|
| ***A43B 7/14*** | (2022.01) |
| ***A43B 7/148*** | (2022.01) |
| ***A43B 13/12*** | (2006.01) |
| ***A43B 13/18*** | (2006.01) |

(52) U.S. Cl.

CPC ..... *A43B 13/12* (2013.01); *A43B 7/148* (2013.01); *A43B 13/125* (2013.01); *A43B 13/18* (2013.01); *A43B 13/188* (2013.01)

(58) Field of Classification Search

CPC ..... A43B 7/144; A43B 7/148; A43B 7/149; A43B 13/125; A43B 13/188

See application file for complete search history.

(56) References Cited

U.S. PATENT DOCUMENTS

| | | | | |
|---|---|---|---|---|
| 4,794,707 A * | 1/1989 | Franklin | ..... | A43B 7/148 36/31 |
| 5,086,574 A * | 2/1992 | Bacchiocchi | ..... | A43B 21/26 36/36 A |
| 5,768,802 A * | 6/1998 | Bramani | ..... | A43B 7/146 36/35 R |
| 6,497,057 B1 | 12/2002 | Lee et al. | | |
| 7,249,425 B2 | 7/2007 | Wang | | |

(Continued)

FOREIGN PATENT DOCUMENTS

WO WO-2009017350 A1 2/2009

OTHER PUBLICATIONS

International Search Report for PCT Patent Application No. PCT/US2021/032702, dated Aug. 17, 2021.

(Continued)

*Primary Examiner* — Sharon M Prange

(74) *Attorney, Agent, or Firm* — Troutman Pepper Locke LLP; Gabrielle L. Gelozin

(57) ABSTRACT

A shoe comprises an outsole, a midsole operatively connected to the outsole, an insole operatively connected to the midsole, the midsole and insole each having at least one aperture therein, and a cushion. The cushion includes at least one pillar extending generally upwardly from outsole through the at least one aperture in the midsole and the aperture in the insole. The cushion can further include a radial flange sandwiched between the outsole and the midsole.

11 Claims, 6 Drawing Sheets

(56) References Cited

U.S. PATENT DOCUMENTS

| | | | | |
|---|---|---|---|---|
| 7,559,158 | B2 | 7/2009 | Rosendahl | |
| 9,814,280 | B2 | 11/2017 | Buck, IV et al. | |
| 2007/0033835 | A1 | 2/2007 | Bray | |
| 2007/0101613 | A1 | 5/2007 | Rosendahl | |
| 2007/0256327 | A1* | 11/2007 | Suarez | A43B 13/184 36/35 B |
| 2008/0184594 | A1 | 8/2008 | Ebeling | |
| 2008/0313924 | A1* | 12/2008 | Righetto | A43B 7/1445 36/43 |
| 2010/0095551 | A1 | 4/2010 | Gupta et al. | |
| 2011/0005101 | A1 | 1/2011 | Sills | |
| 2011/0126422 | A1 | 6/2011 | Vattes et al. | |
| 2014/0310981 | A1 | 10/2014 | Abshire et al. | |
| 2015/0196082 | A1* | 7/2015 | Van Atta | A43B 7/148 36/103 |
| 2018/0035747 | A1 | 2/2018 | Buck, IV et al. | |
| 2018/0303197 | A1* | 10/2018 | Chen | A43B 13/188 |

OTHER PUBLICATIONS

Extended European Search Report of the European Patent Office, dated Dec. 16, 2024, in corresponding European Patent Application No. 21940979.4.

* cited by examiner

Fig. 7
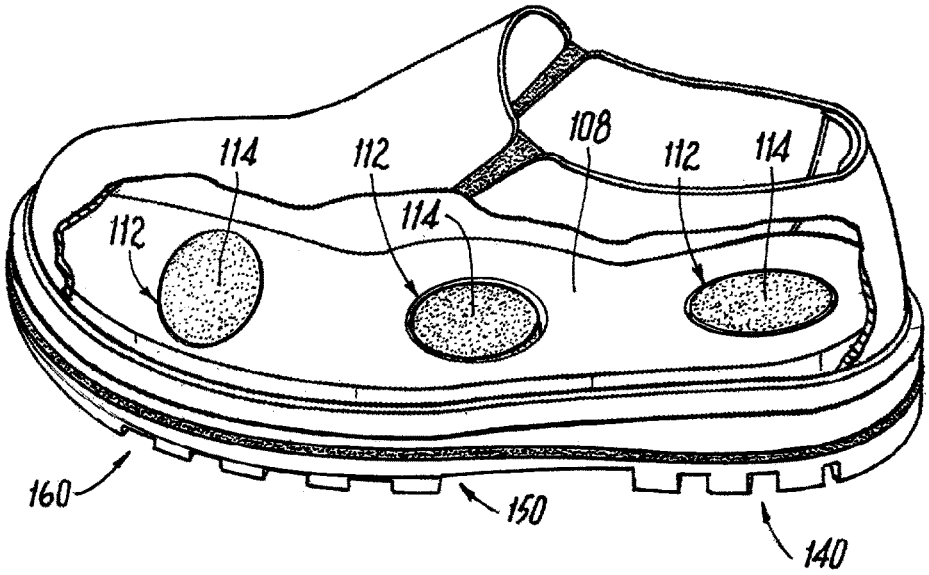
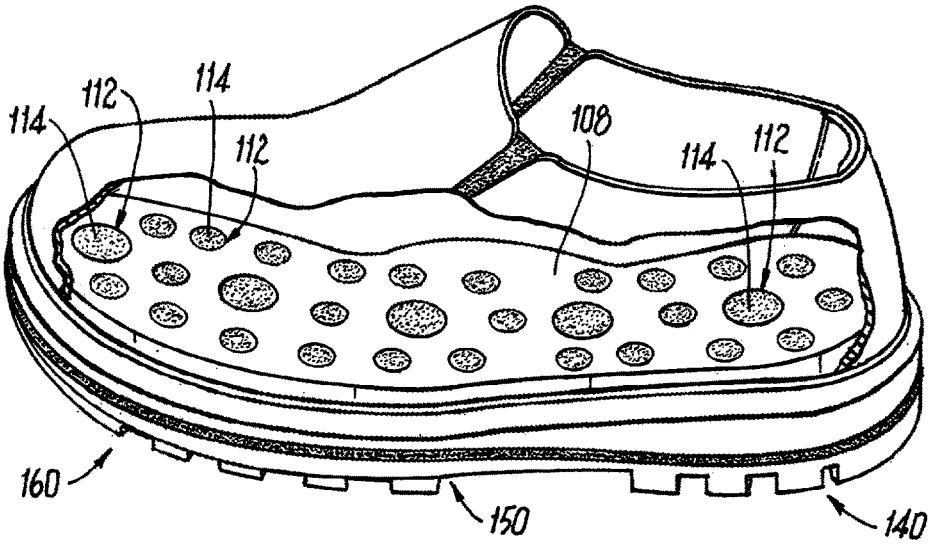
Fig. 8
Fig. 9
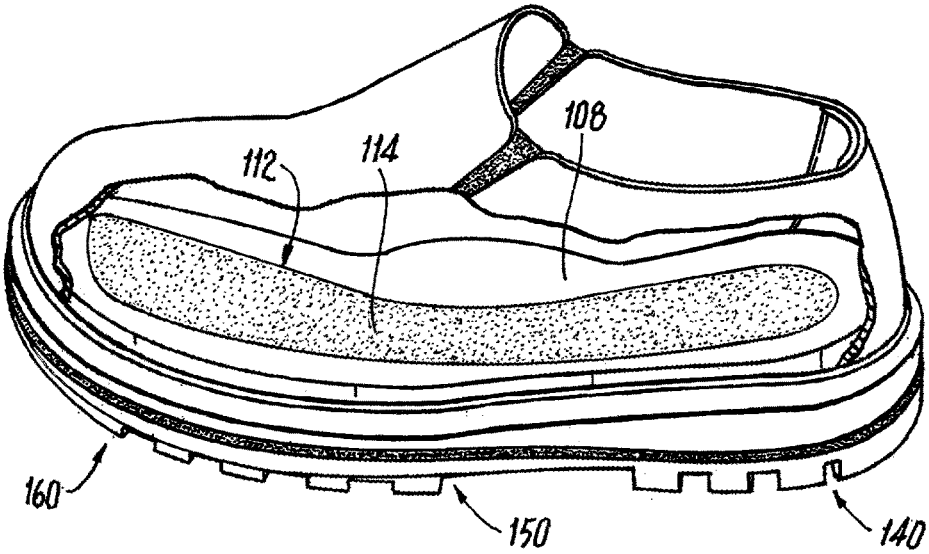

SYSTEMS AND METHODS FOR CUSHIONED FOOTWEAR

This application is the U.S. National Stage of PCT International Application No. PCT/US2021/032702, filed May 17, 2021. The entire disclosure of this application is incorporated herein by reference in its entirety.

FIELD

This disclosure relates to footwear, and more particularly to footwear having cushions therein.

BACKGROUND

A typical shoe comprises a plurality of formed layers connected together. The materials comprised in the formed layers are often chosen for a desired purpose, for example, durability, style, and/or comfort. However, materials often provide singular benefit, requiring wearers to introduce additional layers for additional functionality. To provide this additional functionality, wearers frequently need to purchase additional custom insoles or orthotics.

A variety of heel sole cushions are known in the art. U.S. Patent Pub. No. 2014/0310981 to Abshire et al. describes a cushioning and support layer that cushions and supports a foot and an afferent feedback biomechanical support plate positioned between the cushioning and support layer and the user's foot. U.S. Patent Pub. No. 2007/0033835 to Bray includes an upper sole cushion arrangement at with a lower cover positioned to cover aperture and recessed lip in bottom side of insole base structure. U.S. Patent Pub. No. 2010/095551 to Gupta et al. discloses footwear, footwear inserts, and socks that include a cavity adapted to receive a portion of an individual's heel foot to reduce contact forces.

Such conventional methods and systems of introducing additional layers have generally been the means historically utilized to provide the desired cushioning and comfort. However, to reduce, minimize or eliminate layering, there is a long felt but unsolved need in the art for a shoe having an integrated cushioning element therein. The present disclosure provides a solution that meets this long-felt, unresolved need.

SUMMARY

A shoe comprises an outsole, a midsole operatively connected to the outsole, an insole operatively connected to the midsole, the midsole and insole each having at least one aperture therein, and a cushion. The cushion includes at least one pillar extending generally upwardly from outsole through the at least one aperture in the midsole and the at least one aperture in the insole. The cushion can further include a radial flange sandwiched between the outsole and the midsole.

An upper can be operatively connected to the midsole such that the upper encloses at least a portion of the midsole, the insole, and the at least one pillar. A top surface of the at least one pillar can be flush with a top surface of the insole, or the top surface of the at least one pillar can extend beyond flush with a top surface of the insole. The top surface of the at least one pillar can visible through the at least one aperture in either position.

The cushion can be formed of at least one of a gel, foam, plastic, cork, leather, and/or fluid, having multiple densities. The at least one pillar can have a first density and the radial flange can have second density, where the second density is greater than the first density. The cushion can include a material different from that of the outsole, midsole, insole and/or upper.

A method for constructing a shoe can include forming a last having at least one recess therein, forming a cushion having at least one pillar corresponding to the at least one recess in the last, and forming respective apertures through at least one of a midsole, a connector, and an insole of the shoe, configured and adapted to receive the at least one pillar. The at least one recess of the last can be formed in at least one of a heel portion, a midfoot portion, and/or a forefoot portion such that the at least one pillar extends generally upwardly from an outsole.

The method can include layering the midsole onto the outsole so that the at least one pillar can extend through the at least one aperture in the midsole and that a radial flange of the cushion is sandwiched between the midsole and outsole. The method can also include layering the insole onto the midsole so that the at least one pillar can extend through the at least one aperture in the insole. Further, the method can include attaching an upper to the midsole such that the upper encloses at least a portion of the midsole, the insole and the pillar.

These and other features of the embodiments of the subject disclosure will become more readily apparent to those skilled in the art from the following detailed description taken in conjunction with the drawings.

BRIEF DESCRIPTION OF THE DRAWINGS

To enable those skilled in the art to which the subject disclosure appertains to understand how to make and use the devices and methods of the subject disclosure without undue experimentation, embodiments thereof will be described in detail herein below with reference to certain figures, wherein:

FIG. 7 is a side perspective view of another exemplary embodiment of a shoe constructed in accordance with the present disclosure;

FIG. 8 is a side perspective view of another exemplary embodiment of a shoe constructed in accordance with the present disclosure; and FIG. 9 is a side perspective view of another exemplary embodiment of a shoe constructed in accordance with the present disclosure.

DETAILED DESCRIPTION

Figure 1:
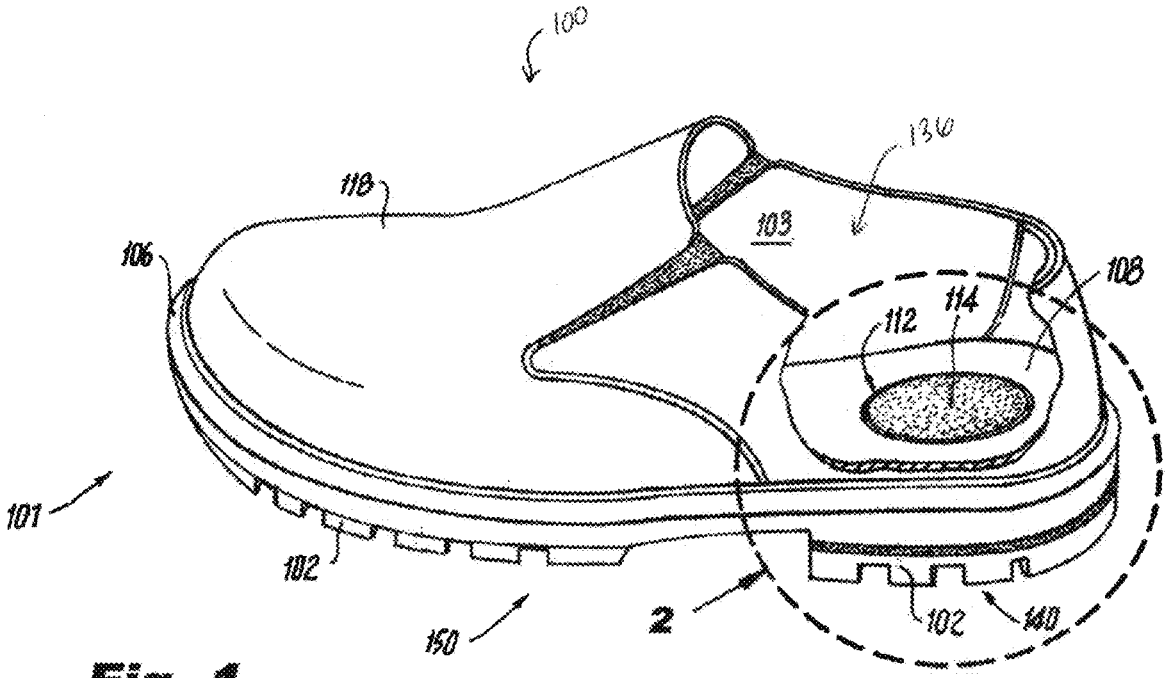
FIG. 1 is a side perspective view of a shoe constructed in accordance with at least one aspect of this disclosure, showing a cushion.
Figure 2:
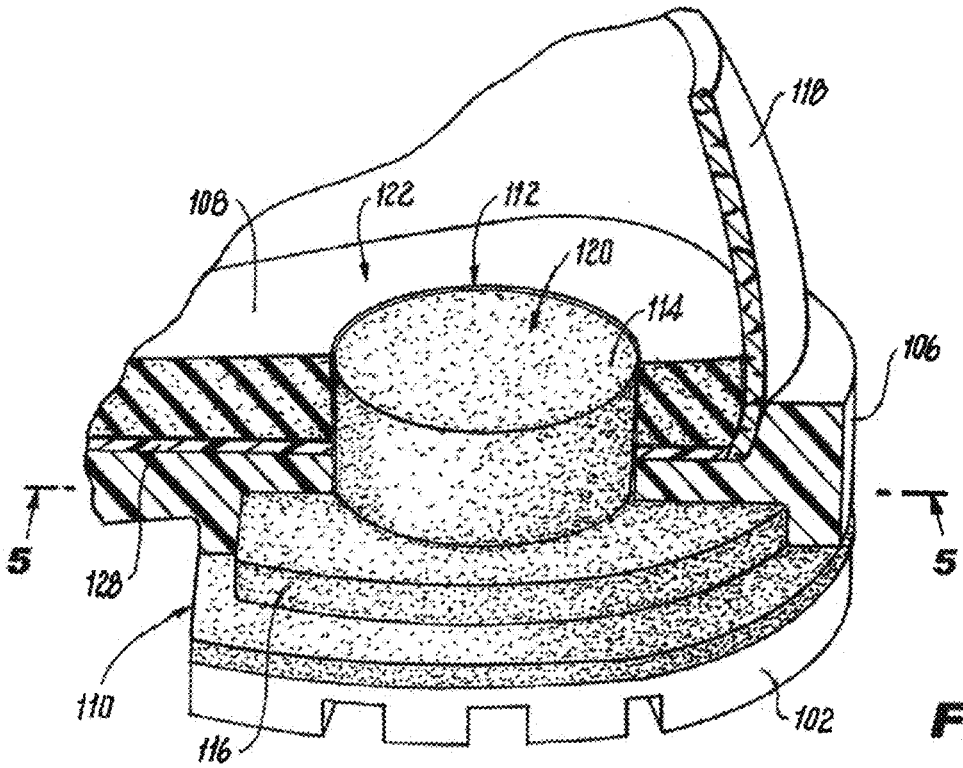
FIG. 2 is a side perspective view of a heel portion of the shoe of FIG. 1 showing the cushion of FIG. 1.

Reference will now be made to the drawings wherein like reference numerals identify similar structural features or aspects of the subject disclosure. For purposes of explanation and illustration, and not limitation, an illustrative view of an embodiment of a shoe in accordance with the disclosure is shown in FIG. 1 and is designated generally by reference character 100. Other embodiments and/or aspects of this disclosure are shown in FIGS. 2-9. Certain embodiments described herein can be used to improve comfort and wearability as compared with traditional cushions.

Figure 3:
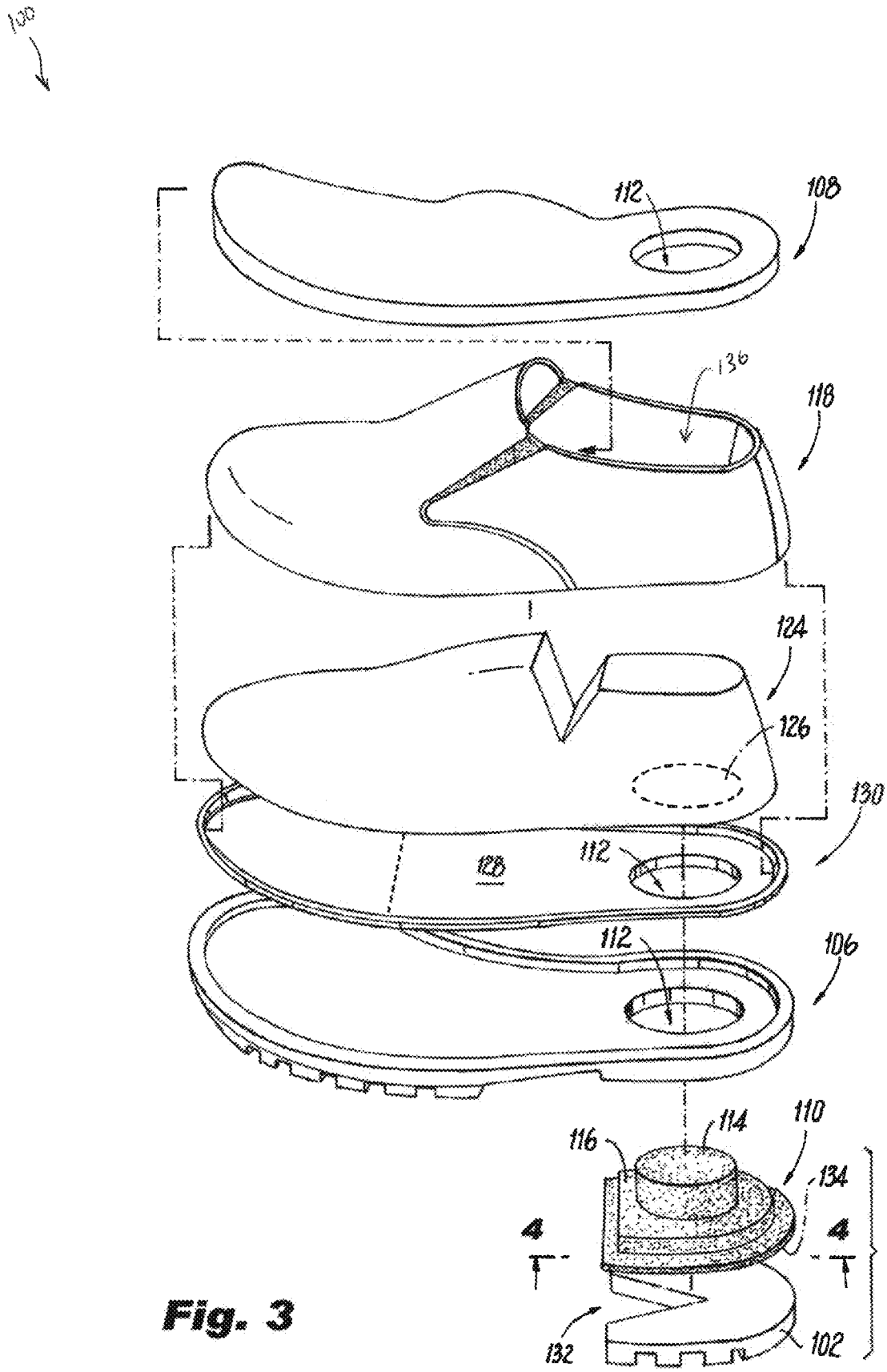
FIG. 3 is a exploded side perspective view of an exemplary embodiment of a shoe constructed in accordance with the present disclosure.
Figure 4:
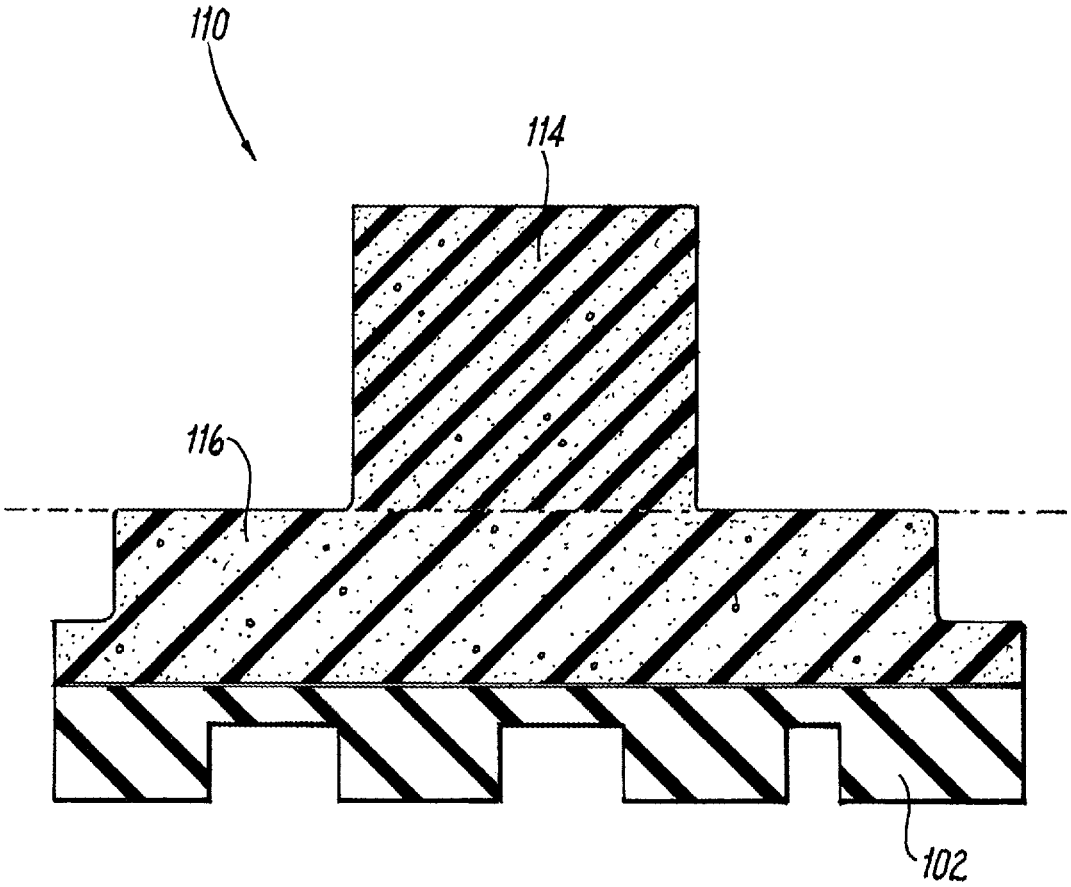
FIG. 4 is an enlarged schematic side cross sectional view of the constructed shoe of FIG. 1, showing the cushion of FIG. 1.

A shoe 100 can include an outsole 102, a midsole 106 operatively connected to the outsole 102 by any suitable means, and an insole 108 operatively connected to the midsole 106 (e.g. friction fitted). The midsole 106 and insole 108 can each include at least one aperture 112 therein for receiving at least one corresponding cushion 110. The cushion 110 can include at least one pillar 114 extending generally upward from outsole 102 and through the respective at least one aperture 112 in the midsole 106 and insole 108. The cushion 110 can further include a radial flange 116 extending radially outward and circumferential to the pillar 114, so that the flange 116 is sandwiched between the outsole 102 and the midsole 106. The radial flange 116 can be visible on an exterior 101 of the shoe 100, while the at least one pillar 114 can be visible through the respective at least one aperture 112 on an interior 103 of the shoe 100. Similarly, the outsole 102 can include at least one notch 132 so that a bottom portion 134 of the cushion 110 can be visible from an underside of the exterior 101 of the shoe 100 (e.g. as shown in FIG. 3). A portion of the cushion 110 is therefore visible from all sides of the shoe 100.

Figure 5:
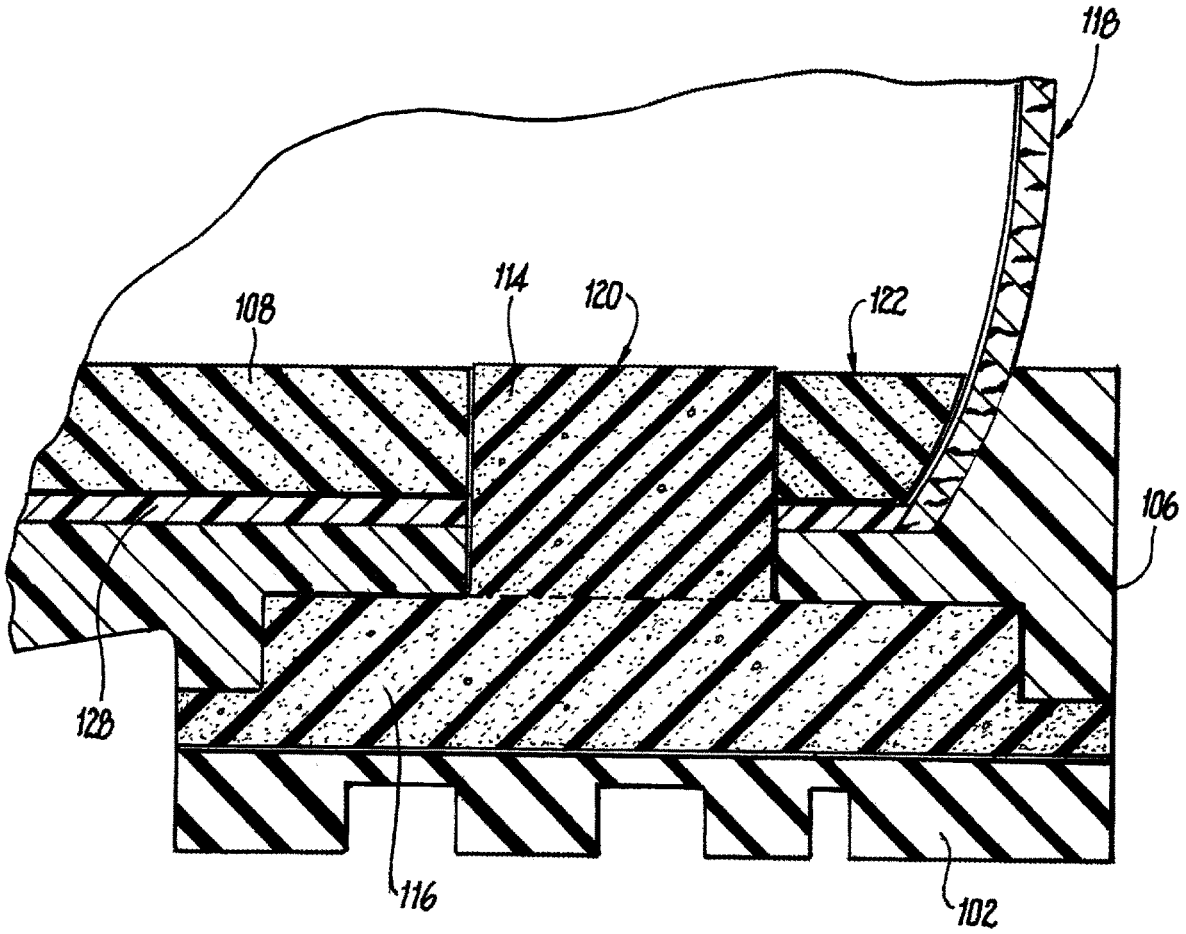
FIG. 5 is a partial side cross-sectional view of the shoe of FIG. 1, showing a first position of the cushion.
Figure 6:
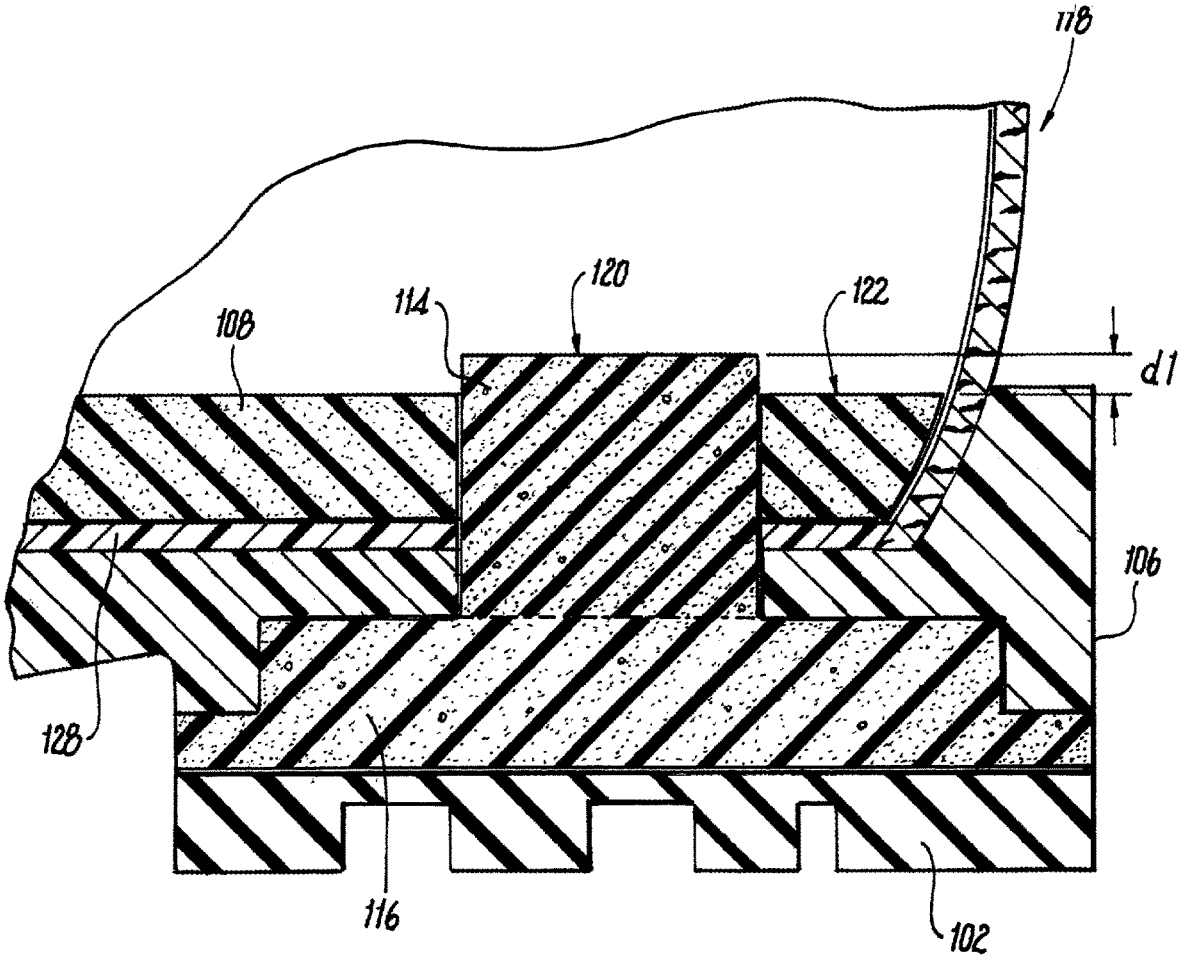
FIG. 6 is a partial side cross-sectional view of the shoe of FIG. 1, showing another position of the cushion.

An upper 118 can be operatively connected to the midsole 106 such that the upper encloses at least a portion of the midsole 106, the insole 108, and the at least one pillar 114, forming interior 103. A top surface 120 of the at least one pillar 114 can be flush with a top surface 122 of the insole 108 (e.g. as shown in FIG. 5). However, it is contemplated that the top surface 120 of the at least one pillar 114 can extend beyond flush with the top surface 122 of the insole 108 (e.g. as shown in FIG. 6, where the at least one pillar 114 extends beyond the top surface 120 by an amount d1). It should be appreciated by those skilled in the art that d1 can be any suitable amount, for example 1 mm-3 mm or less, however it is possible the amount d1 can be determined by the type of shoe 100 and its use, and can vary between embodiments, or within embodiments, without departing from the scope of this disclosure. In any event, the top surface 120 of the at least one pillar 114 can be visible through the at least one aperture 112 in any position, configured to make direct contact with a foot of a wearer without any intervening fabrics, materials, or components of the shoe 100. Direct contact with the at least one pillar 114 can provide the wearer with improved cushioning and comfort, as well as overall performance of the shoe 100.

In certain embodiments, the insole 108 may continuously extend over the at least one aperture 112. In that case, the portion of the insole 108 covering the aperture 112 can include a plurality of geometric openings over aperture 112 for aesthetic purposes, e.g. a plurality of diamond shaped openings, a plurality of honeycomb shaped openings, a plurality of circular or elliptical shaped openings, a plurality of openings in the shape of letters, and the like, or any combination thereof. However, even in this case, the at least one pillar 114 can still directly contact the foot of a wearer through the plurality of openings in the insole. For example, the at least one pillar 114 may be able to extend through the geometric openings in the insole 108 when compressed by a foot.

The cushion 100 can include at least one of a gel and/or foam material having multiple densities, or the cushion 110 can include at least one of plastics, cork, leather, fluid (e.g. air) and the like, or any suitable combination thereof. More specifically, a gel material can include hydrogels, organogels, xerogels, nanocomposite hydrogels, or any suitable combination thereof. The at least one pillar 114 of the cushion 110 can have a first density and the radial flange 116 can have second density. More particularly, the radial flange 116 can be more dense to provide support between the midsole 108 and the outsole 102, whereas the at least one pillar 114 can be a lower density to provide adequate cushioning. The at least one pillar 114 can be, for example, the same or a similar density to that of the insole 108 to provide a feel of continuity throughout the footbed.

It should be appreciated that the at least one pillar 114 and radial flange 116 can have the same density, or the respective densities can be dictated by the type of shoe or the gait of the wearer. For example, in an athletic shoe, the at least one pillar 114 and the radial flange 116 can have a consistent low density across the entirety of the cushion 110, while in a dress shoe, the density can be distributed laterally over a transverse plane. More specifically, in the case of a dress shoe, a medial lateral portion (e.g. from a midline to the outer portion of the foot) of the cushion 110 (including both pillar 114 and radial flange 116) can have a lower density than the opposed portion of the cushion 110. Accordingly, the cushion 110 is not limited to differing densities between the pillar 114 and the radial flange 116, but the cushion can include different densities across any suitable plane. Further, the cushion 110 can include a material different from that of the outsole 102, midsole 106, insole 108 and/or upper 118.

A method for constructing the shoe 100 can include forming a last 124 having at least one recess 126 therein. The cushion 110 can be formed to match the recess 126 of the last 124. For example, as shown in FIGS. 1 and 7-9, the cushion can have a single pillar 114 in the heel portion 140, or a pillar 114 in each of the heel portion 140, midfoot portion 150, and/or forefoot portion 160. In FIG. 8, the cushion can include a plurality of pillars 114 scattered throughout the shoe, having a regular and repeating pattern (as shown), or an irregular, non-repeating pattern. Further, as shown in FIG. 9, the cushion 110 can have a single pillar 114 covering a majority of the footbed. It is contemplated, that while these embodiments are shown separately, it should be appreciated that the cushion 110 can employ any one, or all of these embodiments in a single shoe 100, or any combination thereof as is desired. To form the remainder of the shoe 100, respective apertures 112 corresponding to the at least one pillar 114 can be formed through the midsole 106, the insole 108, and a connector 130, each respective aperture 112 configured to receive the corresponding at least one pillar 114. The connector 130 can be any suitable connector, for example a tuckboard, a strobel sock, a welt, or the like. In certain embodiments, the connector 130 can include a support portion 128 (e.g. a shank) for adding additional structural support between the heel portion 140 and the midfoot portion 150.

The method can further include layering the midsole 108 onto the outsole 102 so that the at least one pillar 114 can extend through the at least one aperture 112, and the radial flange 116 is sandwiched between the outsole 102 and midsole 106 (e.g. using adhesive). If called for, the connector 130 can be layered onto the midsole 108 around the at least one pillar 114 using adhesive or in any other suitable manner. The last 124 is placed onto the connector 130 so that the at least one pillar 114 is mated with the recess 126 in the last 124. The upper 118 is molded or otherwise formed around the last 124, enclosing the interior 103 of the shoe 100.

The upper 118 can be attached to the midsole 106 by any suitable means, for example, using stiches, staples, adhesive, or the like. The outsole 102 can then be connected to the upper 118/midsole 106 combination using similar means. The last 124 is then be removed from the formed interior 103 and the insole 108 can be placed inside the shoe 100 atop the connector 130 so that the respective aperture 112 in the insole 108 matches the position of the at least one pillar 114. Forming the upper 118 can create at least one opening 136 for inserting a foot. It is contemplated that the upper 118 can include any number of openings 136 as desired, typically dictated by the style of the shoe 100. The method as described herein may be suitable for various types of shoe construction, including but not limited to, cement construction, strobel construction, welt construction, direct attach construction, and/or opanka construction, as appreciated by those having ordinary skill in the art.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

Any suitable combination(s) of any disclosed embodiments and/or any suitable portion(s) thereof are contemplated herein as appreciated by those having ordinary skill in the art. The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed:

1. A shoe comprising:

an outsole;

a midsole operatively connected to the outsole;

an insole operatively connected to the midsole forming a footbed, the midsole and insole each having at least one aperture therein; and a cushion having at least one pillar extending generally upwardly from the outsole through the at least one aperture in the midsole and the at least one aperture in the insole, wherein the cushion further includes a radial flange extending radially outward from the at least one pillar and sandwiched between the outsole and the midsole, and wherein the radial flange extends radially outward from the at least one pillar to be flush with the outsole and the midsole such that an outer diameter of the radial flange is visible from an exterior of the shoe, wherein the cushion includes a plurality of pillars distributed about the footbed, wherein each pillar extends upwardly from the outsole through a respective aperture in the midsole and a respective aperture in the insole, wherein the plurality of pillars are scattered throughout the footbed, wherein a plurality of pillars arranged along a midline of the footbed have a larger diameter than a plurality of pillars arranged outward of the midline.

2. The shoe of claim 1, further comprising an upper operatively connected to the midsole, the upper enclosing at least a portion of the midsole, the insole, and the pillars.

3. The shoe of claim 1, wherein a top surface of the at least one pillar is flush with a top surface of the insole.

4. The shoe of claim 1, wherein a top surface of the at least one pillar extends beyond flush with a top surface of the insole.

5. The shoe of claim 1, wherein a top surface of the at least one pillar is visible through the aperture of the insole.

6. The shoe of claim 1, wherein the cushion includes at least one of a gel, foam, plastic, cork, leather, and/or fluid.

7. The shoe of claim 1, wherein the at least one pillar has a first density and the radial flange has a second density, wherein the first density is less than the second density.

8. The shoe of claim 1, wherein the cushion includes a material different from that of the outsole, midsole, insole and/or upper.

9. The shoe of claim 1, wherein each pillar extends upwardly from the outsole through a respective aperture in the midsole and a respective aperture in the insole, wherein the plurality of pillars includes three pillars, wherein one pillar of the three pillars is disposed in each of a heel portion, a midfoot portion, and a forefoot portion of the footbed.

10. A shoe comprising:

an outsole;

a midsole operatively connected to the outsole;

an insole operatively connected to the midsole forming a footbed, the midsole and insole each having at least one aperture therein; and a cushion having at least one pillar extending generally upwardly from the outsole through the at least one aperture in the midsole and the at least one aperture in the insole, wherein the cushion further includes a radial flange extending radially outward from the at least one pillar and sandwiched between the outsole and the midsole, and wherein the radial flange extends radially outward from the at least one pillar to be flush with the outsole and the midsole such that an outer diameter of the radial flange is visible from an exterior of the shoe, wherein the cushion includes a single pillar, wherein the single pillar extends along the footbed from a heel portion to a forefoot portion covering a majority of the footbed.

11. A shoe comprising:

an outsole;

a midsole operatively connected to the outsole;

an insole operatively connected to the midsole forming a footbed, the midsole and insole each having at least one aperture therein; and a cushion having at least one pillar extending generally upwardly from the outsole through the at least one aperture in the midsole and the at least one aperture in the insole, wherein the cushion further includes a radial flange sandwiched between the outsole and the midsole, and wherein at least a portion of the radial flange is visible from an exterior of the shoe, wherein the cushion includes a single pillar, wherein the single pillar extends along the footbed from a heel portion to a forefoot portion covering a majority of the footbed.

* * * * *